United States Patent [19]

Allsop

[11] Patent Number: 5,018,734

[45] Date of Patent: May 28, 1991

[54] GRIP LOCATING APPARATUS FOR SPORTING ARTICLE HANDLE

[76] Inventor: John R. Allsop, 14 Marlborough St., Mont Albert, Victoria, 3127, Australia

[21] Appl. No.: 299,918

[22] PCT Filed: May 13, 1988

[86] PCT No.: PCT/AU88/00142

§ 371 Date: Feb. 28, 1989

§ 102(e) Date: Feb. 28, 1989

[87] PCT Pub. No.: WO88/08733

PCT Pub. Date: Nov. 17, 1988

[30] Foreign Application Priority Data

| | | | |
|---|---|---|---|
| May 13, 1987 | [AU] | Australia | PI 1926 |
| Jun. 12, 1987 | [AU] | Australia | PI 2487 |
| Aug. 31, 1987 | [AU] | Australia | PI 4087 |
| Oct. 16, 1987 | [AU] | Australia | PI 4966 |

[51] Int. Cl.[5] ..... A63B 49/08

[52] U.S. Cl. ..... 273/75; 273/73 J; 273/81 C

[58] Field of Search ..... 273/75, 73 J, 67 DA, 273/81 R, 81 B, 81 C, 81 D, 165

[56] References Cited

U.S. PATENT DOCUMENTS

| | | | |
|---|---|---|---|
| 1,305,952 | 6/1919 | Suesman | 273/81 C |
| 3,203,697 | 8/1965 | Berzatzy | 273/81 D |
| 3,534,960 | 10/1970 | Hanks | 273/75 |
| 3,817,521 | 6/1974 | Wright | 273/75 |
| 3,931,968 | 1/1976 | Hedberg | 273/75 |
| 4,072,311 | 2/1978 | Bertucci | 273/75 |
| 4,101,125 | 7/1978 | Heath | 273/75 |
| 4,693,475 | 9/1987 | Keilhau | 273/81 C |
| 4,819,939 | 4/1989 | Kobayashi | 273/75 |
| 4,826,168 | 5/1989 | McGuire et al. | 273/81 C |

FOREIGN PATENT DOCUMENTS

| | | | |
|---|---|---|---|
| 2444304 | 3/1976 | Fed. Rep. of Germany | 273/75 |
| 2458572 | 6/1976 | Fed. Rep. of Germany | 273/75 |
| 2458581 | 6/1976 | Fed. Rep. of Germany | 273/75 |
| 685710 | 1/1953 | United Kingdom | 273/165 |

*Primary Examiner*—Edward M. Coven
*Assistant Examiner*—William E. Stoll
*Attorney, Agent, or Firm*—Andrus, Sceales, Starke & Sawall

[57] ABSTRACT

A device for positioning a person's hand on the handle of a sporting article such as a tennis racket includes a projection (324) which is intended to fit between the thumb and index finger of a person's hand to locate the hand relative to said article to provide a desired grip. The device also includes adjustment means for radially adjusting the projection (324). The adjustment means may be a band (404) capable of being tensioned and relaxed or a rotatable handle (108) or handle portion (308).

4 Claims, 3 Drawing Sheets

GRIP LOCATING APPARATUS FOR SPORTING ARTICLE HANDLE

This invention relates to sporting articles such as tennis and squash rackets, and golf clubs, and in particular relates to means for the selection of a desired grip by a hand or hands on the handle of such articles.

It is well known that for a tennis player to play effectively, he must change his grip to maximise the effect of the particular shot which he is about to make.

For example, for serving and volleying, a player would normally hold the racket such that the 'V' between the thumb and index finger is a certain line along the longitudinal axis of the racket handle; this is the 'Continental' grip.

For a (right-hander's) forehand shot, the racket head would be rotated about the handle's long axis in an anticlockwise direction as viewed by the player looking down along his or her arm, to close the racket face.

Conversely, for a (right-hander's) backhand, the racket head would be rotated in a clockwise direction, to close the face. The opening and closing of the racket face is undertaken by the other hand (that hand not involved in grasping the racket handle proper) rotating the racket about the handle's long axis.

While a top tennis player may discipline himself or herself to rotate the racket to the appropriate angular position before making a shot, such actions are very difficult for social players to learn, even if they are taking lessons from a coach. A mechanism in a conventional racket handle, to standardize such grip changes and/or to aid the acquisition of such skills, would be considered a significant advance.

In AU-A-36220/84 there is proposed a racket having a handle which may be twisted in relation to the racket head to a desired setting, and then retained in such position by rotation of a handle part, which locks the handle in that position.

It is clear that such a mechanism cannot be used to adjust the racket handle orientation *during* play. In fact, the thrust of the document is to provide a means to set the handle in a backhand grip orientation, and not to cater for the selection of other grips during the course of play. In addition, the rotatable handle portion does not differ in size or cross-section from a conventional racket handle.

U.S. Pat. No. 3, 534, 960 to Hanks discloses a rotatable handle for a tennis racket, in which one of three positions may be selected by gripping the rotatable portion and depressing a lever to temporarily disengage the portion. Although fairings are provided to indicate the position of the hand on a rotatable portion, they are in low relief and are no different from conventional moulded handles found in other applications.

U.S. Pat. No. 4,101,125 to Heath discloses a rotatable handle for a tennis racket in which the racket head and grip are angularly displaceable about a longitudinal axis of the handle with the racket head and grip being positively locked in their relative positions. To locate the elements in their relative positions, dual motion is required; relative longitudinal motion and relative rotational movement between the racket handle and head.

The need for longitudinal displacement renders the arrangement described in U.S. Pat. No. 101,125 ineffective as a means of reliably changing angular displacement as rapidly as can be achieved with a conventional racket handle.

Both U.S. Pat. No. 3, 534, 960 and U.S. Pat. No. 4,101,125 rely upon mechanical engagement of rigid parts to ensure lack of rotation at the critical moment of contact between the racket head and a tennis ball. The use of frictional forces has not been disclosed or suggested as a means of ensuring lack of rotation at such a critical time. In addition the prior art has not proposed tactile guides for the positioning of a hand on an otherwise conventional handle.

It is an object of this invention to provide improved means by which a player's grip on the handle of a sporting article may be regulated in order to provide a desired or the correct grip.

The invention provides apparatus for positioning a person's hand to enable the person to grip a handle in a desired orientation relative to an article to which said handle is attached, including tactile guide means (324) for locating said hand, and adjustment means (308) for adjusting said tactile guide means (324) relative to said article.

The invention also provides apparatus for positioning a person's grip on a handle, including a handle portion (14) which is movable relative to an article (10) of which said handle is a part, and locking means (32) to retain said handle portion (14) at a particular location, said locking means (32) being actuated by the person's grip being tightened, such that said grip may be changed without the person's hand leaving said handle.

The invention further provides apparatus for positioning a person's grip on a handle, including locating means (208) for limited rotational movement relative to said handle, said locating means (208) being adapted to be contacted by at least one of a person's digits, such that the locating means (208) may be rotated, thus causing the person's hand to be rotated relative to said handle.

Embodiments of the invention will be described in detail hereinafter, with reference to the accompanying drawings, in which.

Figure 1:
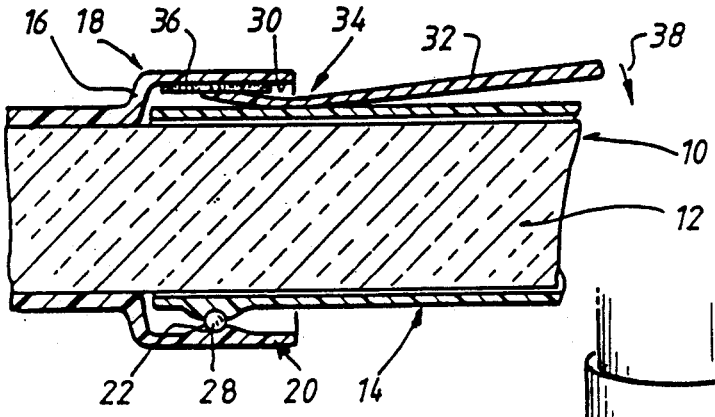
FIG. 1 is a partial longitudinal section of one embodiment of a sporting article handle.
Figure 2:
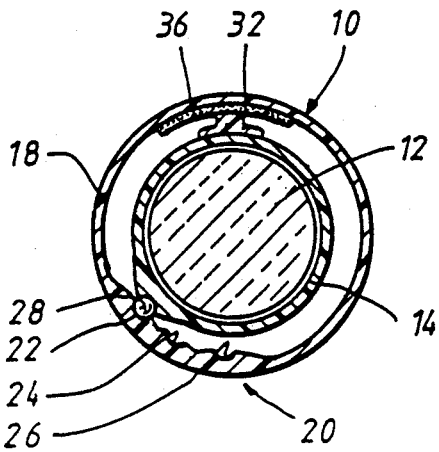
FIG. 2 is a cross-section of the handle of FIG. 1.

In FIG. 1, there is shown the core 12 of a tennis racket handle 10, which is rigidly connected to or is intergral with the frame (not shown) of the racket.

Surrounding core 12 at or near the handle 10 is a sleeve 14, which is that portion of the handle which is intended to be gripped by the user.

Preferably the handle portion 14 would have an external surface moulded to comfortably accommodate the hand of the user, so that the user would be able to easily comfortably, and reproducibly locate his or her hand on the portion 14 easily. This would preferably require suitable moulded fittings for both left-handed and right-handed players. Clearly, such a portion would conveniently be formed from a plastics and/or elastomeric material, although any material would suffice. Further, the 'moulding' may be machined, cut or otherwise processed from any suitable material.

The suggested moulding may take the form of the contact member 324 of FIG. 6, to be described in detail hereinafter. Located on core 12 is an annular flange arrangement 16, with a cylindrical portion 18 parallel to the axis of core 12. As can be seen in FIG. 1, the portion 18 overlies the upper position of handle member 14. On the inner face of portion 18 is a detent arrangement 20 with detents 22, 24, 26.

The outer face of element 14 has a ball 28 mounted in a spring-loaded housing, which enables the element 14 to be rotated relative to core 12 to locate the ball 28 in, any of detents 22, 24, 26, thus locating the element 14 at one of three angular positions. Of course, more or less than three detents could be used, or some other mechanism could be used for locating the handle portion 14 in specific positions relative to core 12. The location of the detents 22,24,26 may also be adjustable prior to play to positions uniquely suited to a given player. Commonly acceptable locations for detents could be indicated on those mechanisms having adjustable detents.

Pivotally attached at 34 to the outer surface of element 14 is a lever 32, which has a bend therein at location 34 as illustrated in FIG. 1. Beyond the bend at location 34 there is located a friction pad 36 which bears on the inner surface 30 of sleeve 18. Thus, lever 32 is able to pivot about location 34, bringing pad 34 into and out of engagement with surface 30.

Figure 3:
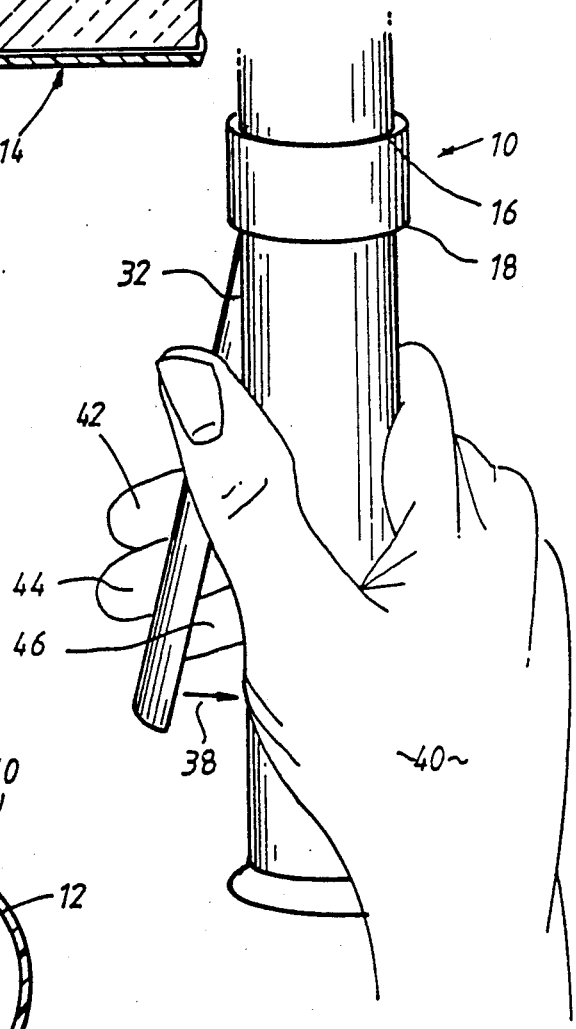
FIG. 3 is a perspective view of the handle of FIG. 1 in a player's grip.

The adjustment means operates as follows, with reference to FIG. 3. When the handle of the racket is gripped other than just before a shot is played, the frictional forces between pad 36 and sleeve 18 are not so great that the element 14 cannot be turned relative to core 12, to one of the three positions; preferably, these are (1) backhand (detent 22), (2) serve/volley (detent 24) and (3) forehand (detent 26). The movement of core 12 relative to element 14 is achieved by element 14 being held in the proximal hand 40 with the middle and distal interphalangeal joints of middle (42) ring (44) and little (46) fingers extended. This can be done quickly, before a shot is played. Thus, as the shot is to be played, the grip is tightened—as it normally is wth a conventional racket—and the tightening of the grip will move lever 32 in the direction of arrow 38 (FIGS. 1 and 3) locking sleeve 14 in place relative to core 12.

Conveniently, the force required to depress lever 32 should not be so great as to put a strain on the hand(s) of the player, but must be strong enough to hold the handle element in a locked position.

Clearly a range of grip sizes would be provided to suit the hand(s) of the player concerned. Such a grip could slide onto sleeve 14, longitudinally, rather then being integrally moulded or formed.

Any suitable material may be used in the construction of the invention. It would of course be preferable to construct rackets and the like with the handle angle adjustment means, but the means could be fitted to an existing handle.

Of course, other means of applying the locking force may be used. For example, handle portion 14 could be of a material sufficiently pliable to allow grasping forces applied to its exterior to be transmitted as a grasping force between the sleeve 14 and the shaft 12, which it surrounds. Element 14 could also be made such that it was infinitely adjustable. Sleeve 14 may be provided with a contact member such as that shown as 324 in FIG. 6.

Figure 4:
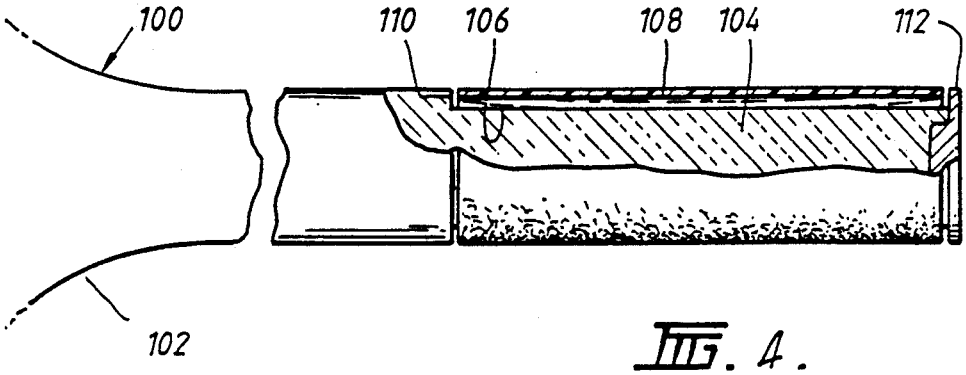
FIG. 4 is a partial longitudinal section of a second embodiment of a sporting article handle.

FIG. 4 illustrates such an alternative manner of applying a frictional locking force. In that Figure, a tennis racket 100 (only part of which is shown) has a frame 102 including a shaft 104. Shaft 104 has a reduced-diameter portion 106 near the end thereof. A sleeve 108 is located on portion 106 and is adapted to rotate about shaft 106 between shoulder 110 and end piece 112. End piece 112 is preferably removable, for the location of sleeve 108, and is preferably fitted with means to set a limit to the angular rotation of said sleeve.

For example, a particular tennis player may set the extremes from 70° to 90° apart. The end piece and/or the shoulder area 110 may be involved in the regulation of angular motion, and may also have means to locate the sleeve at a central position, means which would allow the user to feel or otherwise detect when the sleeve is in such a position. Preferably, the exterior of the sleeve would be moulded to fit the hand of the user.

The sleeve 108 is preferably formed from a pliable or deformable material, such that when gripped lightly, it will rotate relatively freely in relation to shaft 106, but will deform (as shown by the broken lines) when gripped with a grasping force of the magnitude used normally to hold a racket handle when making a shot, and the inner surface thereof will frictionally engage with the outer surface of shaft 106.

Preferably, at least one of the mutually contacting surfaces of parts 106 and 108 is textured or roughened to increase the frictional contact. Preferably, one or both of the said surfaces may consist of fine longitudinally extending parallel ridges and troughs. It is anticipated that such an arrangement would facilitate better locking in a desired position. Sleeve 108 may be provided with a contact member such as that shown as 324 in FIG. 6.

Figure 5:
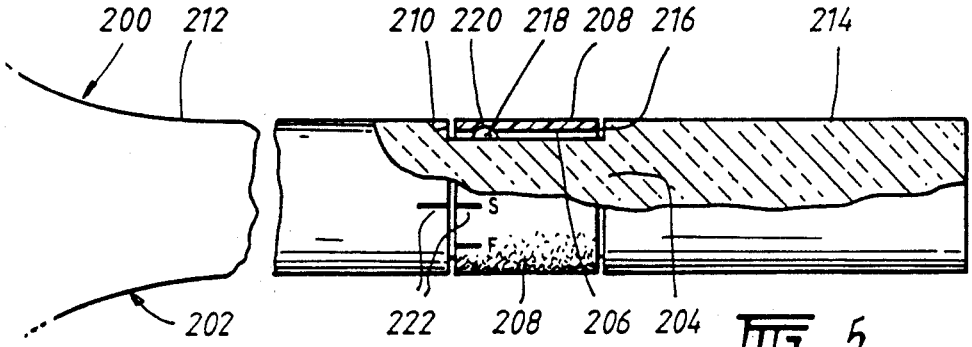
FIG. 5 is a partial longitudinal section of a third embodiment of a sporting article handle.

In FIG. 5 a tennis racket 200 (only part of which is shown) has a frame 202 including a shaft 204. Shaft 204 has a reduced-diameter portion 206 between the throat 212 and rigid handle portion 214. A sleeve 208 is located on portion 206 and is adapted to rotate about shaft 206 between shoulders 210 and 216. The sleeve 208 is formed from a material, such that when gripped lightly by the thumb and first finger it will rotate relatively freely in relation to shaft 206. Some means is desirably provided to ensure positive location of sleeve 208 in a number of annular positions.

FIG. 5 shows a spring-loaded ball 218 located on reduced shaft portion 206. The ball 218 is adapted to seat in a number of detents 220 on the inner face of sleeve 208, enabling the sleeve to be positively located in an angular position relating to the connection between the ball 218 and detent 220. Indicia 222 may be used to aid selection of a particular position. Shown are the letters S and F, representing 'serve' and 'forehand' respectively.

In use, the rigid handle position 214 may be loosely held in the hand. The thumb and first finger grip sleeve 208. They are used to rotate sleeve 208 to a desired angular position, using the indicia as a guide. The three remaining fingers are naturally rotated, relative to rigid handle portion 214. Thus, when the sleeve locates at a desired position, the player may, by gripping portion 214 with the middle, ring and little fingers, end up with the appropriate grip for the desired shot.

It should be mentioned here that this embodiment makes use of the fact that the thumb and index finger are known to be used for 'delicate' work, whilst the middle, ring and little fingers are used for 'heavy' work, such as gripping a tennis racket handle.

Of course, any suitable means for positively locking the sleeve 208 at desired positions could be used.

This embodiment enables rapid and accurate changing of a racket handle grip during play. The illustrated embodiment could be introduced to an existing racket, with minimal difficulty, using a kit of parts. Rackets with such a feature could be manufactured at a reasonable cost.

Figure 6:
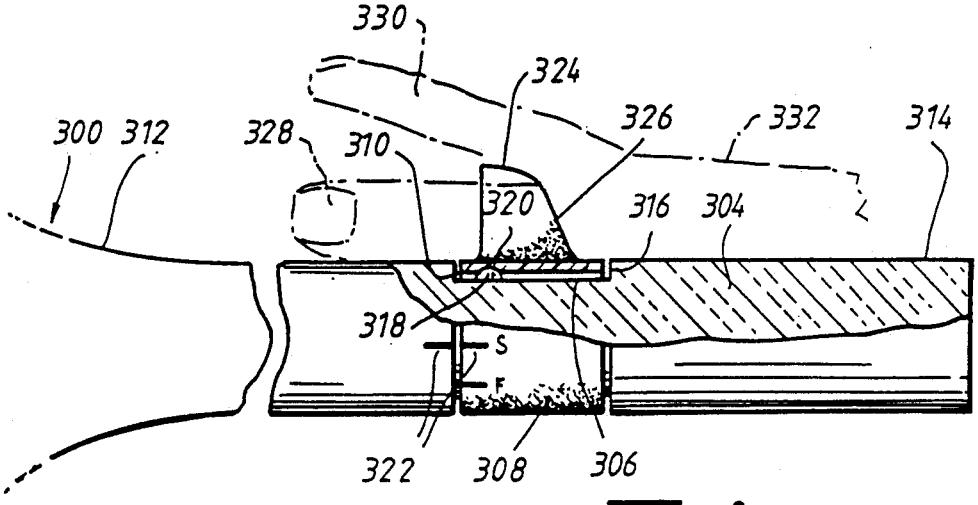
FIG. 6 is a partial longitudinal section of a fourth embodiment of a sporting article handle.

In FIG. 6, even reference numerals 300 to 322 denote the same features, respectively, as even reference numerals 200 to 222 of FIG. 5.

Attached to sleeve 308 or integral therewith is a projecting contact member 324. In this embodiment, the contact member 324 has a rounded outer end 326 adapted to fit comfortably into the 'V' between the thumb 328 and the index finger 330 of a player 332.

In use, the rigid handle position 314 may be loosely held in the hand. The thumb and first finger locate around contact member 324. As the hand 332 is rotated, member 324 is carried with thumb 328 and finger 330 to a desired angular position, using the indicia and/or the sensation of the ball 318 engaging detents 220 as a guide. The three remaining fingers are naturally rotated, relative to rigid handle portion 314. Thus, when the sleeve 308 locates at a desired position, the player may, by locating member 324 between the thumb and first finger, end up with the appropriate grip for the desired shot.

Of course, any suitable means for positively locking the sleeve 308 at desired positions could be used, and the contact member 324 can take any appropriate form.

It can be seen that this embodiment also enables rapid and accurate changing of a racket handle grip during play.

The sleeve 308 and its housing may be constructed so that it occupies 180° or less of the rigid handle portion 314. The projecting contact member 324 may be made detachable from sleeve 308 in a manner that allows its replacement by a flush plate which converts the handle to the configuration of a conventional racket handle devoid of any aid to gripo location. This would allolw the one racket handle to function as both a training article and a competition article, should the rules of the particular sport outlaw the use of such aids in competition.

Figure 7:
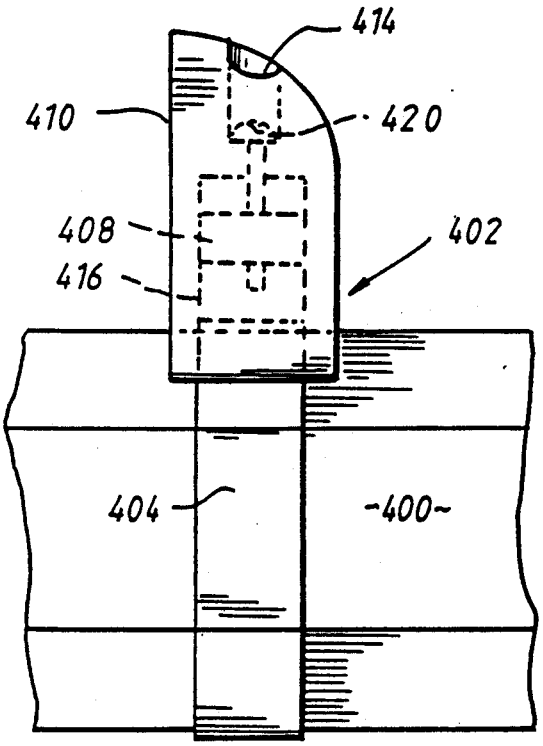
FIG. 7 is a partial side elevation of a sporting racket handle, with a fifth embodiment of the invention shown in partial section.
Figure 8:
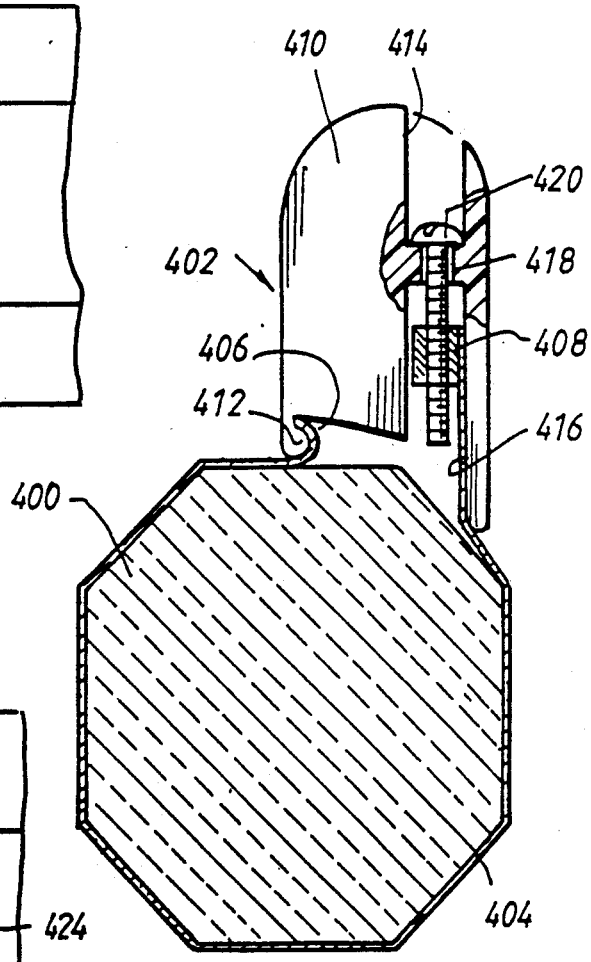
FIG. 8 is a cross-section through the embodiment of FIG. 7.
Figure 9:
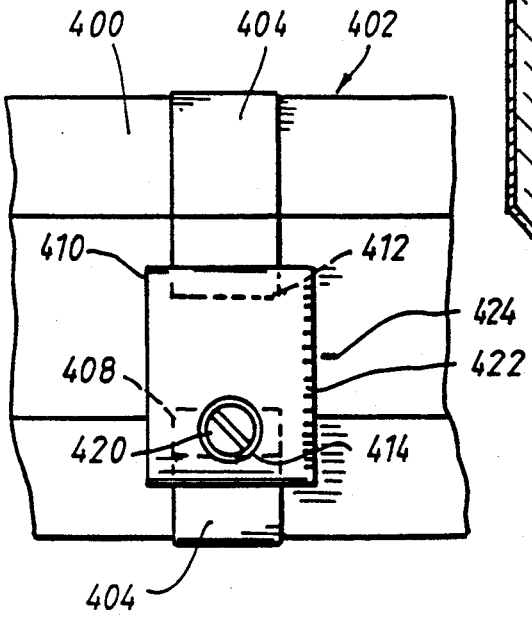
FIG. 9 is a top plan view of the embodiment of FIG. 7.

Referring finally to FIGS. 7 to 9 inclusive, there is illustrated a fifth embodiment of the invention, in the form of an adjustable and removal grip locating means 402 in the form of a strap which may fit around the handle 400 of a tennis racket (otherwise not shown).

The device 402 consists of a band or strap 404, which has at one end a hook 406, and at the other end a threaded block 408.

A projection block 410 (similar to contact member 324 of FIG. 6) has a lip 412 at its lower end and upper and lower recesses 414,416 connected by a bore 418, which is adapted to receive a tensioning screw 420.

Block 410 has an outline similar to that of contact member 324, and is intended to co-operate in the same way with a user's thumb and index finger.

To use the device 402, block 408 is located in recess 416, and screw 420 is caused to enter the threaded portion of block 408, thereby securing the one end of band 404 to the projection 410.

Band 404 may then be passed around handle 400, and lip 412 and hook 406 engaged. Such engagement allows for rapid connection and disconnection of the device 402 to a handle 400.

Screw 420 is then turned to tension band 404 to secure the projection 410 in the desired position of the handle. A scale 422 may be provided on the projection 410 to facilitate the positioning of the device in conjunction with a mark 424 on the handle 400.

It can be seen that the embodiment of FIGS. 7 to 9 is a simple and effective arrangement for allowing a person using a conventional racket to select a desired or the correct grip. The position of the device 402 shown in FIG. 8 is in the approximate location for a forehand grip (right-handed player). The device 402 is infinitely adjustable on handle 400, both radially and longitudinally.

The projection block 410 is preferably moulded from plastics material, as may be the band 404.

For the embodiments of FIGS. 1 to 6, any suitable material(s) may be used. For example, the material of sleeve 108 (FIG. 4) may be a rubber-type material.

Furthermore, it should be understood that whilst all the embodiments described herein relate to tennis rackets, the invention and the embodiments thereof may equally be used for the positioning of a hand or hands on any handle, such as the grip of a golf club (where it is often necessary to open or close the club face), or the handle of a squash racket or badminton racket.

The various embodiments of the present invention provide both for reliably varying the desired grip position rapidly during the course of play and for locking into a desired grip position so that a particular shot may be practised without concern that the grip position may have inadvertently changed between shots.

The invention would be particularly useful for coaches who desire a pupil to concentrate on a particular aspect of play and do not find it practical to repeatedly check the pupils grip, because the pupil will normally be located at the other end of a tennis court.

Embodiments of the invention aim to allow grip changes to be made as rapidly as may be undertaken by a practised person with a conventional racket. However, certainly in the degree of angular rotation required is only possible with the present invention.

I claim:

1. Apparatus suitable for use with a tennis racket having a striking portion and a handle of generally conventional construction, a handle being connected to a striking portion and having an exterior surface that is gripped by a hand of a player during play, a handle having a forward end lying toward the striking portion, a rear end lying toward a butt of the racket and a central axis extending between the ends; said apparatus serving to position a hand of a player on a handle exterior surface so that a player may grip a handle in a plurality of different positions, and comprising:

a projection mountable on a handle to extend from a handle exterior surface generally normal to a handle axis, said projection being formed for comfortable engagement with a portion of a player's hand located between a thumb and index finger, said projection being generally arcuately movable about a handle axis when mounted on a handle for movement relative to a handle exterior surface to a plurality of discrete circumferential locations, a hand of a player, when engaging the projection, being movable on a handle exterior surface to a desired orientation responsive to the rotation of said projection so that a player may grip a handle in a desired one of a plurality of positions; and locating means interposable between said projection and a handle for establishing said discrete circumferential locations of said projection, for releasably retaining said projection at a desired one of said locations, and for releasing said projection from restraint at one of said locations for arcuate movement about a handle axis solely in response to a torque applied to the apparatus about a central axis of a handle.

2. The apparatus according to claim 1, wherein said locating means comprises a ball and detent mechanism interposable between said projection and a handle.

3. The apparatus according to claim 1 wherein said projection is mounted on a sleeve suitable for surrounding a handle.

4. The apparatus according to claim 3, wherein said locating means comprises a ball and detent mechanism interposable between said sleeve and a handle.

* * * * *